US008317313B2

(12) United States Patent
Mandel

(10) Patent No.: US 8,317,313 B2
(45) Date of Patent: Nov. 27, 2012

(54) PRINTING SYSTEMS WITH PROGRESSIVE IMAGE TRANSFER AND PROGRESSIVE RADIANT ENERGY EXPOSURE OF IMAGES FOR MULTI-PASS PRINTING, PRINTING APPARATUSES AND CORRESPONDING METHODS

(75) Inventor: Barry P. Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 352 days.

(21) Appl. No.: 12/729,685

(22) Filed: Mar. 23, 2010

(65) Prior Publication Data

US 2011/0234723 A1 Sep. 29, 2011

(51) Int. Cl.
*B41J 2/01* (2006.01)

(52) U.S. Cl. ..... 347/102; 347/103; 347/213; 399/299; 399/303; 399/313; 271/289; 271/9.13

(58) Field of Classification Search ..... None
See application file for complete search history.

(56) References Cited

U.S. PATENT DOCUMENTS

| | | | | |
|---|---|---|---|---|
| 6,167,229 | A * | 12/2000 | Watanabe et al. | 399/313 |
| 6,396,528 | B1 * | 5/2002 | Yanagawa | 347/213 |
| 6,543,890 | B1 * | 4/2003 | Ylitalo et al. | 347/102 |
| 6,728,505 | B2 * | 4/2004 | Omata et al. | 399/303 |
| 7,440,720 | B2 * | 10/2008 | Takehara | 399/299 |
| 7,645,560 | B1 | 1/2010 | Iftime et al. | |
| 2006/0066704 | A1 * | 3/2006 | Nishida | 347/103 |
| 2007/0120930 | A1 | 5/2007 | Domoto et al. | |

OTHER PUBLICATIONS

Bryan J. Roof et al.; Method and Apparatus for Fixing a Radiation-Curable Gel-Ink Image on a Substrate; U.S. Appl. No. 12/256,670, filed Oct. 23, 2008.

* cited by examiner

*Primary Examiner* — Matthew Luu
*Assistant Examiner* — John P Zimmermann
(74) *Attorney, Agent, or Firm* — Ronald E. Prass, Jr.; Prass LLP

(57) ABSTRACT

Printing systems, printing apparatuses and methods of forming images on media are provided. An exemplary embodiment of the printing systems includes a rotatable intermediate member including an outer surface on which marking material can be applied by a marking system to form an image via multiple passes of the intermediate member past the marking system; a transport device including a rotatable transport belt having an inlet end and an outlet end, the transport device being movable relative to the outer surface of the intermediate member to engage the transport belt with a medium starting at the inlet end at which a leading edge of the medium enters and progressively increase an engagement zone with the medium toward the outlet end as the leading edge of the medium advances, the outer surface and the transport belt forming an image transfer/curing zone along which the image is transferred from the outer surface to the medium, the image transfer/curing zone increasing in length as the transport belt is progressively engaged with the advancing medium; and a radiating device including a radiant energy source adapted to simultaneously progressively expose the image to radiant energy while the image is being transferred to the medium along the image transfer/curing zone.

25 Claims, 6 Drawing Sheets

PRINTING SYSTEMS WITH PROGRESSIVE IMAGE TRANSFER AND PROGRESSIVE RADIANT ENERGY EXPOSURE OF IMAGES FOR MULTI-PASS PRINTING, PRINTING APPARATUSES AND CORRESPONDING METHODS

BACKGROUND

Ink-jet printing apparatuses can include different direct marking architectures. A first architecture can jet ink directly onto media and then cure/level the ink. A second architecture jets ink onto an intermediate member to produce an image and then transfers the image to a medium while simultaneously exposing the ink to radiant energy to cure the ink. Exemplary printing systems having this architecture are disclosed in U.S. Patent Application Publication No. 2007/0120930, which is incorporated herein by reference in its entirety.

It would be desirable to provide printing systems and printing apparatuses that include an intermediate member and provide simultaneous image transfer and curing with increased productivity in multi-pass printing.

SUMMARY

Printing systems, printing apparatuses and methods with progressive image transfer and progressive exposure of marking materials to radiant energy for multi-pass printing are provided. An exemplary embodiment of the printing systems comprises a rotatable intermediate member including an outer surface on which marking material can be applied by a marking system to form an image via multiple passes of the intermediate member past the marking system; a transport device including a rotatable transport belt having an inlet end and an outlet end, the transport device being movable relative to the outer surface of the intermediate member to engage the transport belt with a medium starting at the inlet end at which a leading edge of the medium enters and progressively increase an engagement zone with the medium toward the outlet end as the leading edge of the medium advances, the outer surface and the transport belt forming an image transfer/curing zone along which the image is transferred from the outer surface to the medium, the image transfer/curing zone increasing in length as the transport belt is progressively engaged with the advancing medium; and a radiating device including a radiant energy source adapted to simultaneously progressively expose the image to radiant energy while the image is being transferred to the medium along the image transfer/curing zone.

DRAWINGS

DETAILED DESCRIPTION

Figure 1:
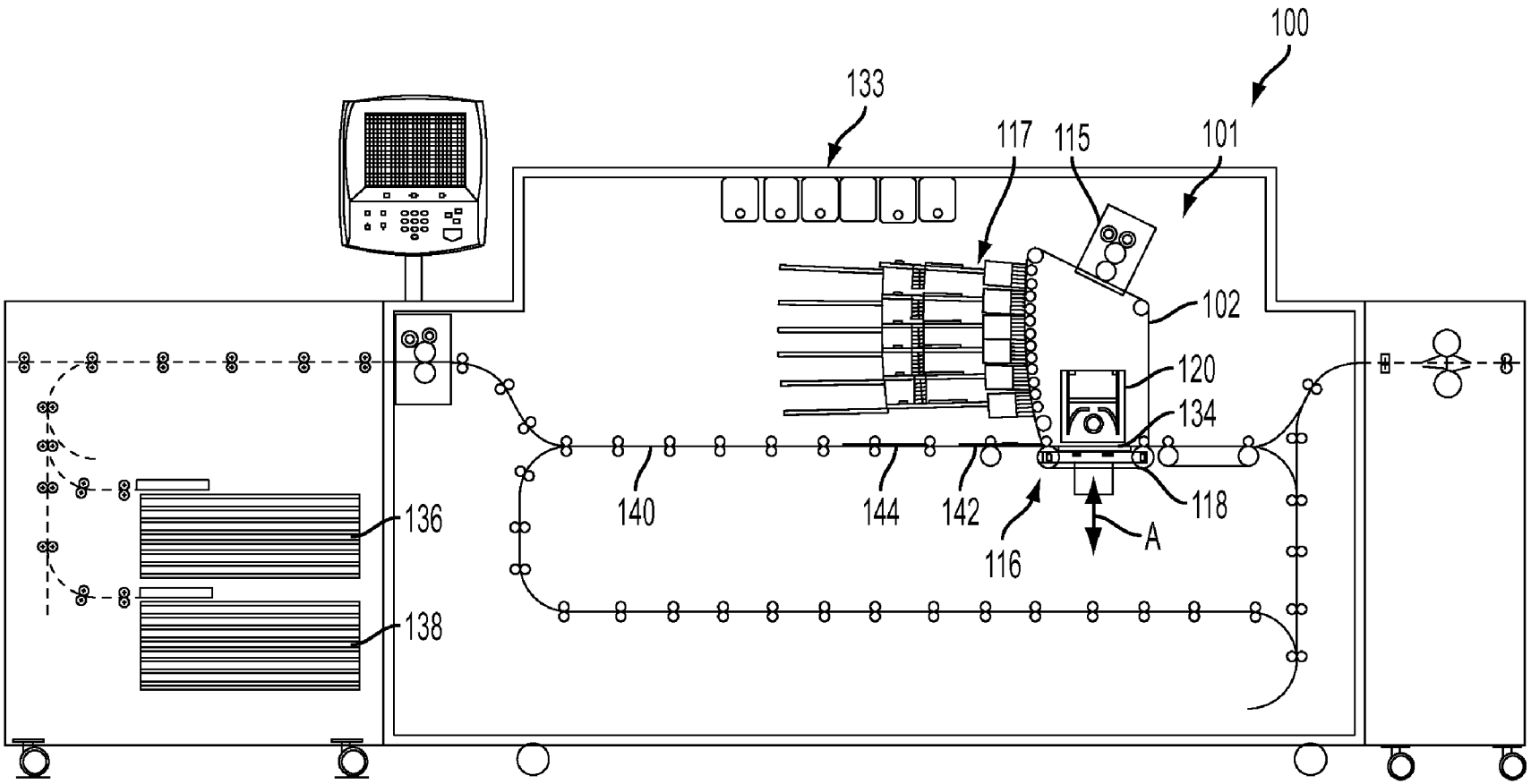
FIG. 1 depicts a printing apparatus including a printing system having an intermediate belt and a transport device.

The disclosed embodiments include printing systems. An exemplary embodiment of the printing systems comprises a rotatable intermediate member including an outer surface on which marking material can be applied by a marking system to form an image via multiple passes of the intermediate member past the marking system; a transport device including a rotatable transport belt having an inlet end and an outlet end, the transport device being movable relative to the outer surface of the intermediate member to engage the transport belt with a medium starting at the inlet end at which a leading edge of the medium enters and progressively increase an engagement zone with the medium toward the outlet end as the leading edge of the medium advances, the outer surface and the transport belt forming an image transfer/curing zone along which the image is transferred from the outer surface to the medium, the image transfer/curing zone increasing in length as the transport belt is progressively engaged with the advancing medium; and a radiating device including a radiant energy source adapted to simultaneously progressively expose the image to radiant energy while the image is being transferred to the medium along the image transfer/curing zone.

The disclosed embodiments further include printing apparatuses. An exemplary embodiment of the printing apparatuses comprises a rotatable intermediate member including an outer surface; a marking section adapted to apply marking material to the outer surface of the intermediate member to form an image on the outer surface via multiple passes of the intermediate member past the marking section; a transport device including a rotatable transport belt having an inlet end and an outlet end, the transport device being movable relative to the outer surface of the intermediate member to engage the transport belt with a medium starting at the inlet end at which a leading edge of the medium enters and progressively increase an engagement zone with the medium toward the outlet end as the leading edge of the medium advances, the outer surface and the transport belt forming an image transfer/curing zone along which the image is transferred from the outer surface to the medium, the image transfer/curing zone increasing in length as the transport belt is progressively engaged with the advancing medium; and a radiating device including a radiant energy source adapted to simultaneously progressively expose the image to radiant energy while the image is being transferred to the medium along the image transfer/curing zone.

The disclosed embodiments further include methods of forming images on media in a printing system. An exemplary embodiment of the methods comprises forming an image on an outer surface of a rotating intermediate member via multiple passes of the intermediate member past a marking system; moving a transport device including a rotatable transport belt having an inlet end and an outlet end relative to the outer surface of the intermediate member to engage the transport belt with a medium starting at the inlet end at which a leading edge of the medium enters and progressively increase an engagement zone with the medium toward the outlet end as the leading edge of the medium advances, the outer surface and the transport belt forming an image transfer/curing zone along which the image is transferred from the outer surface to the medium, and the image transfer/curing zone increasing in length as the transport belt is progressively engaged with the advancing medium; and simultaneously progressively exposing the image to radiant energy emitted by a radiating device while the image is being transferred to the medium along the image transfer/curing zone.

FIG. 1 depicts an exemplary printing apparatus 100 including an image transfer/curing zone. The printing apparatus 100 includes a continuous intermediate belt 102, a marking system 117 including an array of print heads, and a transport device 116 including a transport belt 118. A belt cleaning device 115 is provided to clean the outer surface of the intermediate belt 102. The transport belt 118 is movable in reverse directions toward and away from the intermediate belt 102, as indicated by the arrow A. When the transport device 116 is moved upwardly in direction A, the entire upper span of the transport belt 118 engages with the intermediate belt 102 at the same time. A radiant energy device 120 is positioned internal to the intermediate belt 102. An ink supply system 133 supplies inks to the print heads of the marking system 117.

The intermediate belt 102 and the transport belt 118 together form an image transfer/curing zone 134. Media are fed from media feeders 136, 138 to the image transfer/curing zone 134 along media path 140. At the image transfer/curing zone 134, an image is transferred from the intermediate belt 102 to a medium 142 and the image is irradiated by radiant energy emitted by the radiant energy device 120 to cure the ink.

In the printing apparatus 100, the image transfer/curing zone 134 where the intermediate belt 102 contacts a medium is relatively long. In the printing apparatus 100, in order to engage the intermediate belt 102 and a medium without inadvertently damaging or curing a portion of the image on the intermediate belt 102, a long, non-image zone is left blank (i.e., not imaged) on the intermediate belt 102. The non-image zone has a length equal to about the length of the illustrated span of the intermediate belt 102 at the image transfer/curing zone 134. Leaving a long non-image zone on the intermediate belt 102 reduces the number of images that can be generated at one time in multi-pass mode, which significantly reduces the productivity of the printing apparatus 100.

In light of these considerations, printing systems and methods of forming images on media are provided that can provide increased (desirably maximized) productivity in multi-pass printing with simultaneous image transfer and curing. Embodiments of the printing systems include an intermediate member and a transport device that form an image transfer/curing zone where an image is transferred from the intermediate member to medium while radiant energy is simultaneously applied to the image to cure the ink forming the images.

Marking material is applied to the intermediate member by a marking system to form images on the intermediate member. The marking material can be various types of ink or toner. The printing systems include a transport device that allows progressive engagement with media advancing along the process direction over the functional length of the image transfer/curing zone, and a radiant energy device that allows progressive radiant energy exposure of images along the image transfer/curing zone. Additionally, the transport device allows contact between the intermediate member and the transport device ahead of the media to be avoided. By progressively engaging and exposing images on media, embodiments of the printing systems allow images to be formed along substantially the entire circumference of the intermediate member and thereby provide significantly-improved productivity.

Figure 2:
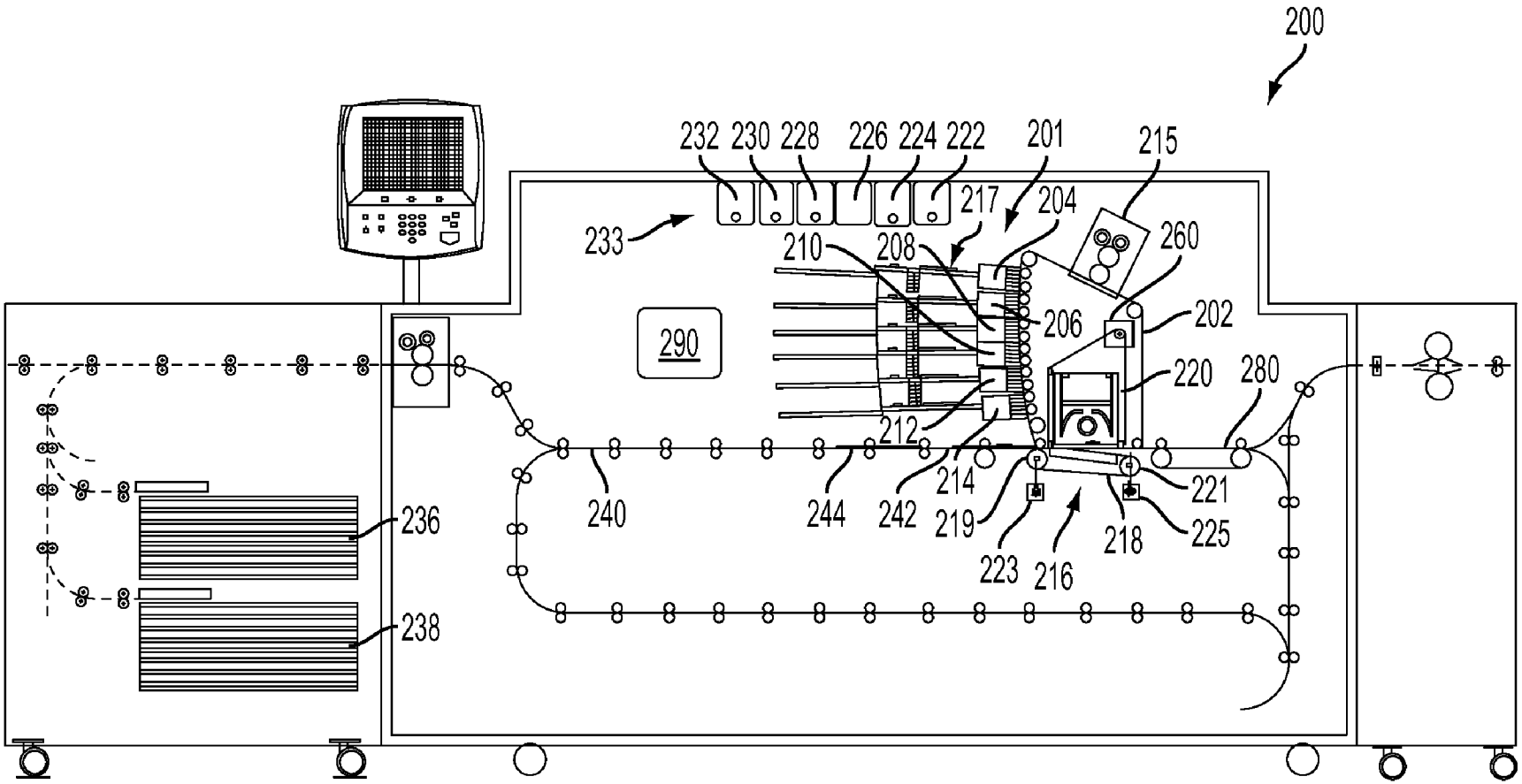
FIG. 2 depicts a printing apparatus including an exemplary embodiment of a printing system including an intermediate belt and a transport device that can progressively engage with media advancing along an image transfer/curing zone, and a radiant energy device that can progressively expose images on the advancing media to radiant energy along the image transfer/curing zone.
Figure 3:
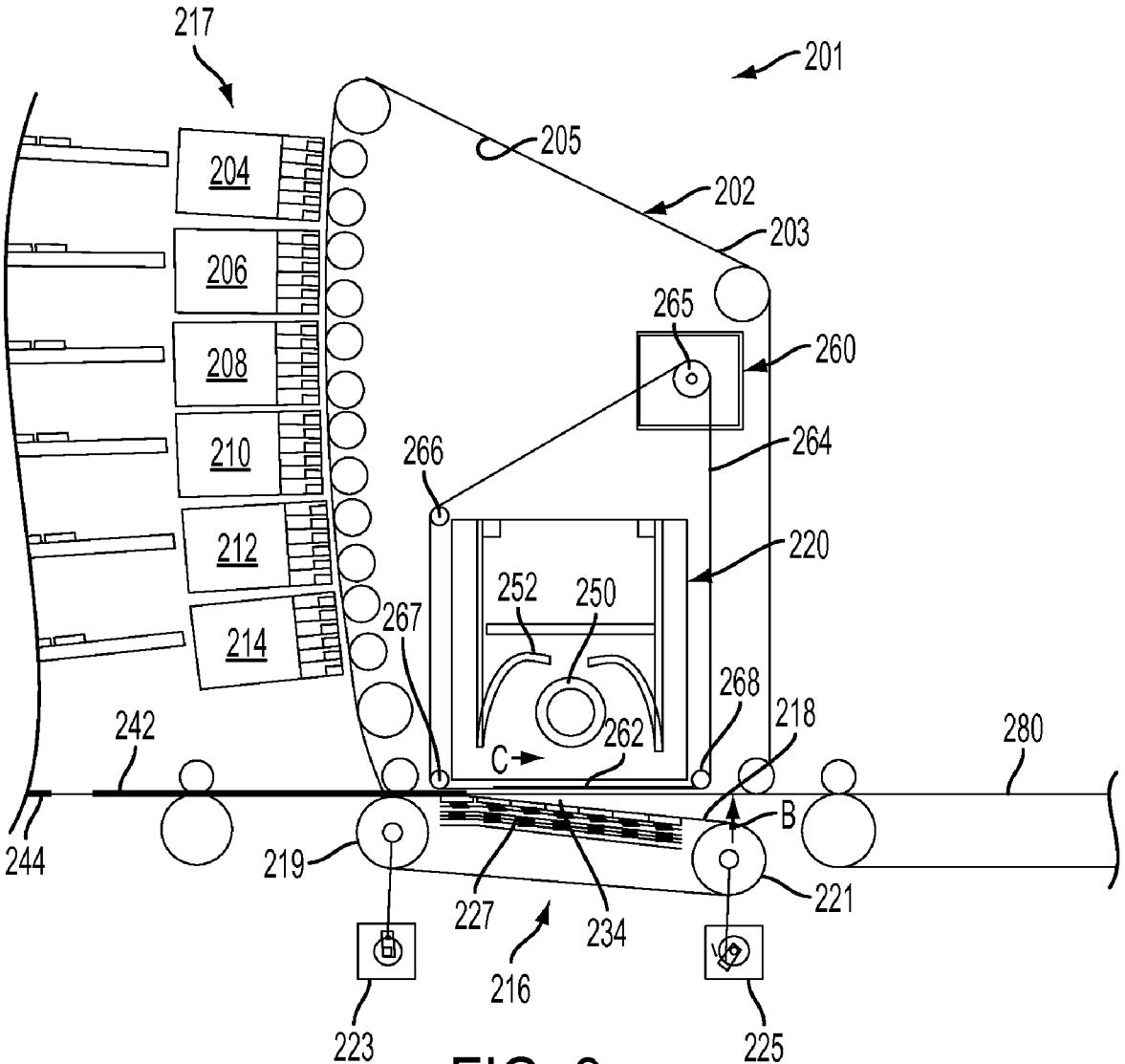
FIG. 3 is an enlarged view of the printing system shown in FIG. 2.

FIGS. 2 and 3 illustrate a printing apparatus 200 including an exemplary embodiment of a printing system 201. The printing system 201 can provide progressive engagement with media along an image transfer/curing zone, and includes a radiant energy device that allows progressive radiant energy exposure of images along the image transfer/curing zone. The printing system 201 includes a rotatable, continuous intermediate belt 202.

Ink is applied to the outer surface 203 of the intermediate belt 202 by a marking system 217 to form images. The marking system 217 includes an array of print heads 204, 206, 208, 210, 212 and 214 (e.g., ink-jet print heads) operable to apply inks of different colors to the outer surface 203 of the intermediate belt 202 rotating in the counter-clockwise direction. An image is built up on the intermediate belt 202 via multiple passes past the marking system 217. Multi-pass printing can produce higher image quality, hide jetting defects, and allow the printing systems to include fewer print-heads. An ink supply system 233 includes ink supplies 222, 224, 226, 228, 230 and 232 in communication with the print heads 204, 206, 208, 210, 212 and 214, respectively. A belt cleaning device 215 is positioned to clean marking material and debris from the outer surface 203 of the intermediate belt 202. The belt cleaning device 215 (not shown) can be included in the printing system 201 shown in FIG. 3.

The printing system 201 further includes a transport device 216. The transport device 216 includes a rotatable, continuous transport belt 218 entrained on rolls 219, 221. The roll 219 is at the inlet end and the roll 221 is at the outlet end of the transport device 216. The rolls 219, 221 are connected to drives 223, 225, respectively. The drives 223, 225 can be independently actuated.

The transport device 216 is movable to form an image transfer/curing zone 234 with the intermediate belt 202. Media are fed from media feeders 236, 238, advance to the media staging and registration zone 240 and then advance to the image transfer/curing zone 234 (FIG. 3). At the image transfer/curing zone 234, an image is transferred from the intermediate belt 202 to a medium, and the image is exposed to radiant energy effective to cure the ink forming the image.

The transport device 216 includes a compliant span with a plurality of spring elements 227 internal to the transport belt 218. The spring elements 227 can be spring plates, or the like. The spring elements 227 allow progressive engagement of the transport belt 218 and the intermediate belt 202. The force produced by the spring elements 227 causes the transport belt 218 to apply pressure to media at the image transfer/curing zone 234. The applied pressure is sufficient to provide physical leveling of inks applied to the media.

In the printing system 201, the transport device 216 is movable, in a controlled manner, relative to the intermediate belt 202 to progressively engage with a medium (i.e., increase an engagement zone), beginning with engaging the lead edge of the medium. The transport device 216 can be moved relative to the intermediate belt 202 in the following manner. First, the inlet end of the transport device 216 is moved by the drive 223 to the position shown in FIGS. 2 and 3, in which the inlet end of the transport belt 218 engages with the intermediate belt 202 and a medium. Then, with the inlet end of the transport device 216 in the raised position, the outlet end of the transport device 216 is progressively moved in the direction B by the drive 225 to progressively move the transport belt 218 upwardly as the medium advances in the process direction. As the outlet end of the transport device 216 is moved upwardly, the length of the image transfer/curing zone 234, at which the intermediate belt 202 and the transport belt 218 both engage with the medium, progressively increases.

The printing system 201 includes a radiating device 220 located internal to the intermediate belt 202. The radiating device 220 includes a radiant energy source 250 that emits radiant energy of the desired wavelength range, depending on the type of ink applied to the intermediate belt 202. In embodiments, the ink can be a radiation-curable ink composition that undergoes curing when exposed to the radiant energy. The ink can be a UV-curable ink, or the like, and the radiant energy source 250 can be a UV lamp for emitting UV radiation effective to cure the ink.

The intermediate belt 202 is substantially transparent to the radiant energy emitted by the radiant energy source 250 to allow the radiant energy to impinge on a medium at the image transfer/curing zone 234. For example, the intermediate belt 202 can be composed of a polymer that is substantially transparent to the radiant energy. The radiating device 220 includes a curved reflector 252 configured to direct radiant energy emitted by the radiant energy source 250 toward the image transfer/curing zone 234 to impinge on a medium contacting the upper span of the transport belt 218 to cure the ink on the medium.

The radiating device 220 provides a movable shutter system that can protect images formed on the intermediate belt 202 from exposure to radiant energy emitted by the radiant energy source 250 before the images are ready to be transferred to media at the image transfer/curing zone 234. The shielding device 260 includes a radiant energy shield 262 disposed between radiant energy source 250 and the inner surface 205 of the intermediate belt 202. The radiant energy shield 262 is composed of a material that is opaque to the radiant energy emitted by the radiant energy source 250.

The radiant energy shield 262 is connected to a belt 264 entrained on a pulley 265 and rolls 266, 267 and 268. The pulley 265 is driven by a motor to rotate the belt 264 counterclockwise, which moves the radiant energy shield 262 in the direction C. Moving the radiant energy shield 262 in the direction C increases the exposure area of the radiant energy and allows progressive exposure of images on media moving along the length of the image transfer/curing zone 234 in contact with the intermediate belt 202 and transport belt 218. The movement of the radiant energy shield 262 in the direction C can be synchronized with the movement of the transport belt 218 in the direction B and the corresponding progressive engagement of the transport belt 218 with a medium to allow only the image on the portion of the intermediate belt 202 that is ready for transfer to be exposed. The radiating device 220 and transport device 216 can be connected to a controller 290 configured to control the operation of these devices.

The printing apparatus 200 includes a transport 280 positioned downstream from the image transfer/curing zone 234.

FIG. 3 depicts a first medium 242 having a leading edge at the image transfer/curing zone 234. The first medium 242 can be a coated or uncoated paper sheet, for example. A trailing second medium 244 is also shown. As the first medium 242 advances in the process direction, the outlet end of the transport device 216 is moved upwardly by the drive 225 to progressively engage the transport belt 218 with the first medium 242 and increase the length of the image transfer/curing zone 234. As the first medium 242 advances, pressure is applied to the first medium 242 to level the ink on the first medium 242.

Radiating of the first medium 242 is commenced when the leading edge is disposed at the inlet end of the image transfer/curing zone 234. As the first medium 242 advances and the length of the image transfer/curing zone 234 is increased, the radiant energy shield 262 is simultaneously moved in the direction C to expose an increasing length of the image that has been transferred to the first medium 242 to radiant energy emitted by the radiant energy source 250.

In embodiments, the transport belt 218 I is maintained engaged (i.e., with the outlet end of the transport device 216 in the fully-raised position) while all media of a print run pass through the image transfer/curing zone 234. Once the radiant energy shield 262 has moved in direction C until the entire image transfer/curing zone 234 is exposed to radiant energy, the radiant energy shield 262 can then be driven clockwise until it is positioned near to roll 267 and the inlet end of the transport device 216. Then, after the last medium and image are transferred, the radiant energy shield 262 can be driven at the same speed as the intermediate belt 202 to block the radiant energy from reaching the new, partially-formed image that has just been deposited onto the intermediate belt 202 by the marking system 217. When the last medium is being driven through the image transfer/curing zone 234, the drive 223 can be operated to gradually disengage the inlet end of the transport device 216 to prevent contact with the new, partially-formed image on the intermediate belt 202.

The progressive engagement with media provided by the movable transport device 216 provides advantages in multi-pass printing. These advantages include allowing the first medium 242 to enter the image transfer/curing zone 234 without damaging or curing the trailing edge of the last image on the intermediate belt 202.

The progressive engagement with media allowed by the controlled movement of the transport device 216 can provide a significant productivity improvement, with the amount of the improvement depending on the ratio of the functional length of the image transfer/curing zone 234 to the total length of the intermediate belt 202. For example, the intermediate belt 202 can be a five-pitch belt with a length of about 1200 mm and the span of the intermediate belt 202 at the fully-formed image transfer/curing zone 234 can have a length of about 210 mm long. For this belt configuration, in a printing apparatus that does not provide progressive engagement (e.g., printing apparatus 100), only four images can be generated at one time in the multi-pass mode and the system productivity is only about 80% efficient. In contrast, the use of progressive media engagement and progressive image radiating in the printing system 201 can yield an increase of about 25% in productivity in multi-pass modes by allowing images to be placed around substantially the entire circumference (length) of the intermediate belt 202.

In the printing system 201, the transport device 216 can also be progressively disengaged as the trailing edge of the last medium passes through the image transfer/curing zone 234. The transport device 216 can be progressively disengaged starting by moving the inlet end of the transport device 216 downwardly away from the intermediate belt 202 by activating the drive 223, and then activating the drive 225 to move the outlet end of the transport device 216 relative to the intermediate belt 202. This movement of the transport device 216 allows a newly-formed image on the intermediate belt 202 to pass through the image transfer/curing zone 234 without being contacted by the transport belt 218. The radiant energy emission from the radiant energy source 250 can be simultaneously blocked by movement of the radiant energy shield 262 to progressively decrease the exposure area of the radiant energy. This progressive disengagement allows the next set of images to be placed immediately after the last image of the previous image set to maximize productivity. Alternatively, a "blank" section without an image can optionally be left on the intermediate belt 202 during the first revolution of the intermediate belt 202 after image transfer/curing to give the printing system 210 sufficient time to fully disengage, or to move the radiant energy shield 262 into position.

In embodiments in which progressive disengagement of the transport device 216 is optionally not used, the effect on productivity is small because not using disengagement results in only a one-time delay in starting the next image set, and the full length of intermediate belt 202 is still usable for images. For example, not using progressive disengagement in a five-pitch, six-pass printing system may cause approximately a one-pitch delay in 30 or 35, which equals about a 3% effect in productivity.

Figure 4:
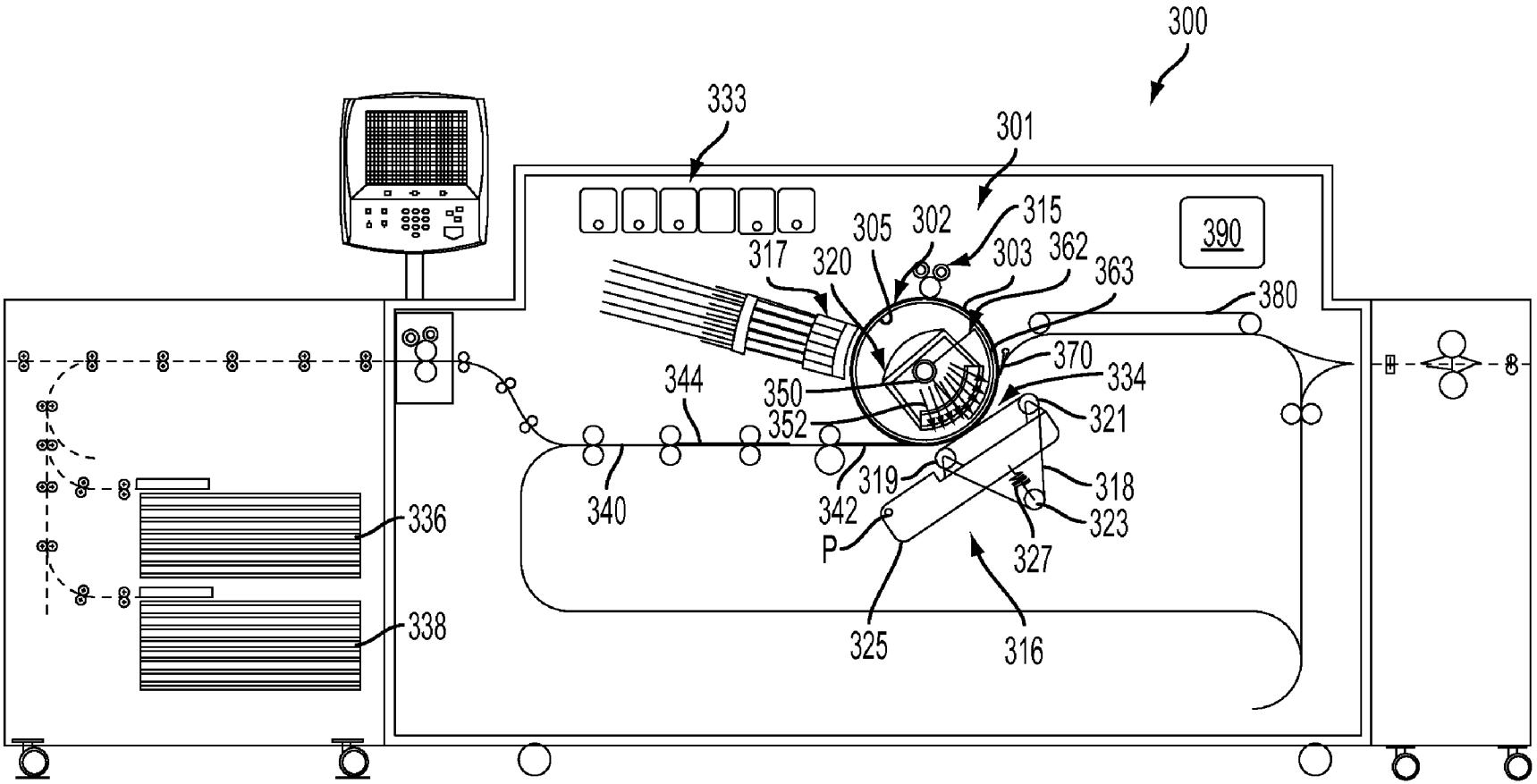
FIG. 4 depicts a printing apparatus including another exemplary embodiment of a printing system including an intermediate drum and a transport device that can progressively engage with media advancing along an image transfer/curing zone, and a radiant energy device that can progressively expose images on the advancing media to radiant energy along the image transfer/curing zone.

FIG. 4 depicts a printing apparatus 300 including another exemplary embodiment of a printing system 301 that can provide progressive engagement (and progressive disengagement) with media over a length of an image transfer/curing zone, and that includes a radiant energy device that allows progressive radiant energy exposure of images along the image transfer/curing zone.

The printing system 301 includes an intermediate drum 302 having an outer surface 303. Ink is applied to the outer surface 303 by a marking system 317 to form images. The marking system 317 includes an array of print heads (e.g., ink-jet print heads) positioned to apply inks onto the intermediate drum 302 rotating in the counter-clockwise direction. An image is built on the intermediate drum 302 via multiple passes past the marking system 317. An ink supply system 333 is in communication with the respective print heads of the marking system 317. A cleaning device 315 cleans the outer surface 303 of the intermediate drum 302 during rotation.

The printing system 301 further includes a transport device 316. The transport device 316 includes a rotatable, continuous transport belt 318 entrained on rolls 319, 321 and 323 attached to a support member 325. A spring element 327 is attached to the roll 323 and the support member 325. The spring element 327 resiliently biases the roll 323 away from the support member 325 to produce tension in the transport belt 318.

The support member 325 includes a pivot axis P about which the transport device 316 is pivoted. As shown, the pivot axis P is located off-center of the support member 325 to allow off-center rotary motion of the transport device 316. When the transport device 316 is pivoted counter-clockwise about pivot axis P, the length of the image transfer/curing zone 334 formed between the outer surface 303 of the intermediate drum 302 and the transport belt 318 progressively increases.

Media are fed from media feeders 336, 338, advance to the media staging and registration zone 340 and then advance to the image transfer/curing zone 334. At the image transfer/curing zone 334, an image is transferred from the intermediate drum 302 to a medium, and the image is exposed to radiant energy to cure the ink forming the image. The transport belt 318 applies sufficient pressure to a medium at the image transfer/curing zone 334 to provide physical leveling of ink on the medium.

In the printing system 301, the transport device 316 is movable relative to the intermediate drum 302 in a controlled manner to progressively engage with a medium, beginning with the lead edge of the medium. The transport device 316 can be moved relative to the intermediate drum 302 in the following manner. First, the transport device 316 is either rotated counter-clockwise or moved upwardly until the inlet end of the transport belt 318 overlying the roll 319 engages with the intermediate drum 302 and a medium. Then, the transport device 316 is pivoted counter-clockwise about the pivot axis P as the medium advances in the process direction. As the transport device 316 is pivoted, the compliant span of the transport belt 318 extending between the rolls 319, 321 is deflected and the length of the image transfer/curing zone 334, at which the intermediate drum 302 and the transport belt 318 both engage with the advancing medium, progressively increases.

The printing system 301 includes a radiating device 320 located internal to the intermediate drum 302. The radiating device 320 includes a radiant energy source 350 that emits radiant energy 352 of the desired wavelength range for curing ink applied to the intermediate drum 302. For example, the radiant energy source 350 can be a UV lamp, or the like, for emitting UV radiation effective to cure UV-curable ink. The intermediate drum 302 is substantially transparent to the radiant energy 352 emitted by the radiant energy source 350 to allow the radiant energy 352 to impinge on media at the image transfer/curing zone 334. The intermediate drum 302 can be composed of a clear polymer, glass, a quartz material, or the like. The radiating device 320 can include a reflector (not shown) for directing the radiant energy 352 toward the image transfer/curing zone 334 to impinge on media contacting the transport belt 318 to cure the ink on the media.

The radiating device 320 provides a movable shutter system that can protect images formed on the intermediate drum 302 from exposure to the radiant energy 352 emitted by the radiant energy source 350 before the images are ready to be transferred to media at the image transfer/curing zone 334. A radiant energy shield 362 is disposed internal to the intermediate drum 302. The radiant energy shield 362 is composed of a material that is opaque to the radiant energy 352. The radiant energy shield 362 includes a curved portion 363, which faces the inner surface 305 of the intermediate drum 302 and can extend over an angular range of, e.g., about 90°, as shown.

The radiant energy shield 362 is connected to a drive (not shown), such as a motor, or the like, to rotate the curved portion 363 counter-clockwise while the intermediate drum 302 rotates. Moving the radiant energy shield 362 in this manner allows progressive exposure of images on media as the media move along the length of the image transfer/curing zone 334 in contact with the intermediate drum 302 and the transport belt 318. The rotation of the radiant energy shield 362 is synchronized with the pivoting of the transport device 316 in the counter-clockwise direction and the associated progressive engagement of the transport belt 318 with a medium to allow the image only on the portion of the intermediate drum 302 that is ready for transfer to a medium to be irradiated. The radiating device 320 and the transport device 316 can be connected to a controller 390 configured to control the operation of these devices.

The printing system 301 includes a stripping element 370 for mechanically stripping media from the outer surface 303 of the intermediate drum 302 after passing through the image transfer/curing zone 334. The stripping element 370 can comprise, e.g., an array of fingers with sharp leading edges, a flat blade with a sharp leading edge, or the like.

The printing apparatus 300 includes a transport 380 positioned downstream from the stripping element 370.

FIG. 4 depicts a first medium 342 including a leading edge disposed at the image transfer/curing zone 334. A second medium 344 is shown trailing the first medium 342. As the first medium 342 advances in the process direction, the transport device 316 is pivoted counter-clockwise to cause the transport belt 318 to progressively engage with the first medium 342 and increase the length of the image transfer/curing zone 334. As the first medium 342 advances, pressure is applied to the first medium 342 to level the ink.

Radiating of the first medium 342 is commenced when its leading edge enters the image transfer/curing zone 334. As the first medium 342 advances and the length of the image transfer/curing zone 334 progressively increases, the radiant energy shield 362 is simultaneously rotated counter-clockwise to expose an increasing length of the as-transferred image on the first medium 342 to radiant energy 352 emitted by the radiant energy source 350.

In embodiments, the transport belt 318 remains engaged while all media of a print run pass through the image transfer/curing zone 334. The radiant energy shield 362 can be stopped just past the outlet end of the image transfer/curing zone 334 and quickly returned to its start position after the last medium in a group leaves the image transfer/curing zone 334. Alternatively, the radiant energy shield 362 can be rotated counter-clockwise and positioned near the inlet end of the image transfer/curing zone 334 to allow the radiant energy shield 362 to be used to shield the leading edge of the first new image set from radiant energy.

The progressive engagement with media provided by the movable transport device 316 allows the first medium 342 to enter the image transfer/curing zone 334 without damaging or curing the trailing edge of the last image on the intermediate drum 302.

In the printing system 301, the progressive engagement with media allowed by movement of the transport device 316 can provide a significant productivity improvement. The amount of this improvement depends on the ratio of the functional length of the image transfer/curing zone 334 to the outer circumference of the intermediate drum 302. For example, if the intermediate drum 302 is a five-pitch drum, and if the image transfer/curing zone 334 length is approximately equal to one pitch, then the printing system 301 can typically provide an increase of about 25% in productivity in multi-pass printing by allowing images to be placed around substantially the entire circumference of the intermediate drum 302.

The transport device 316 can also be progressively disengaged as the trailing edge of the last medium passes through the image transfer/curing zone 334. The transport device 316 can be progressively disengaged starting by moving the inlet end of the transport belt 318 overlying the roll 319 downwardly away from the intermediate drum 302, followed by pivoting the transport device 316 clockwise. This movement of the transport device 316 allows a newly-formed image on the intermediate drum 302 to pass through the image transfer/curing zone 334 without being contacted by the transport belt 318. The radiant energy emission from the radiant energy source 350 can be simultaneously blocked by the radiant energy shield 362. This progressive disengagement allows the next set of images to be placed immediately after the last image of the previous image set to maximize productivity. Alternatively, a "blank" section without an image can be left on the first pass of the intermediate drum 302 to give the printing system 301 sufficient time to fully disengage in a non-progressive fashion. This will result in a short time delay in the start of the next image set.

Figure 5A:
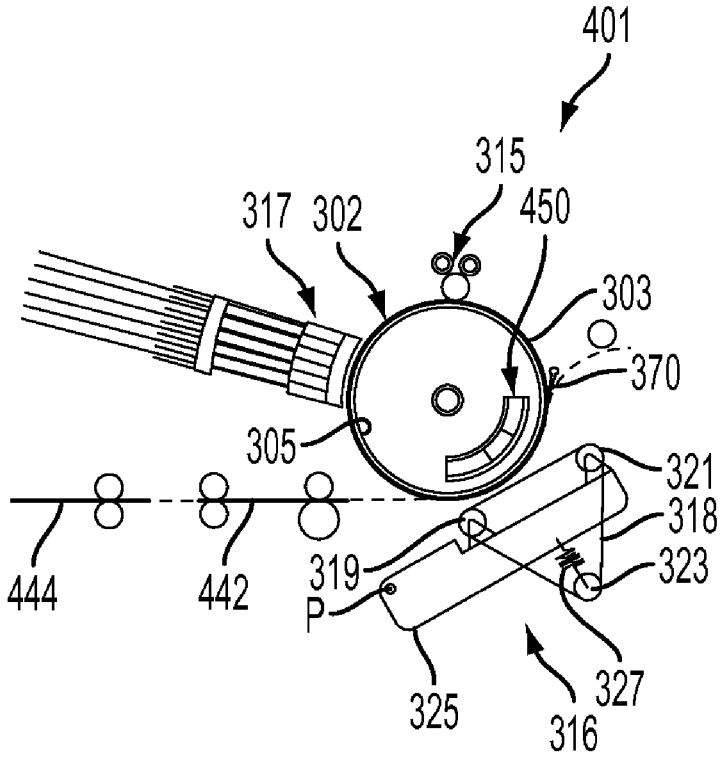
FIGS. 5A to 5C depict a sequence of operation of another exemplary embodiment of a printing system including an intermediate drum and a transport device that can progressively engage with media advancing along an image transfer/curing zone, and an array of radiant energy sources that can progressively expose images on the advancing media to radiant energy along the image transfer/curing zone.
Figure 5B:
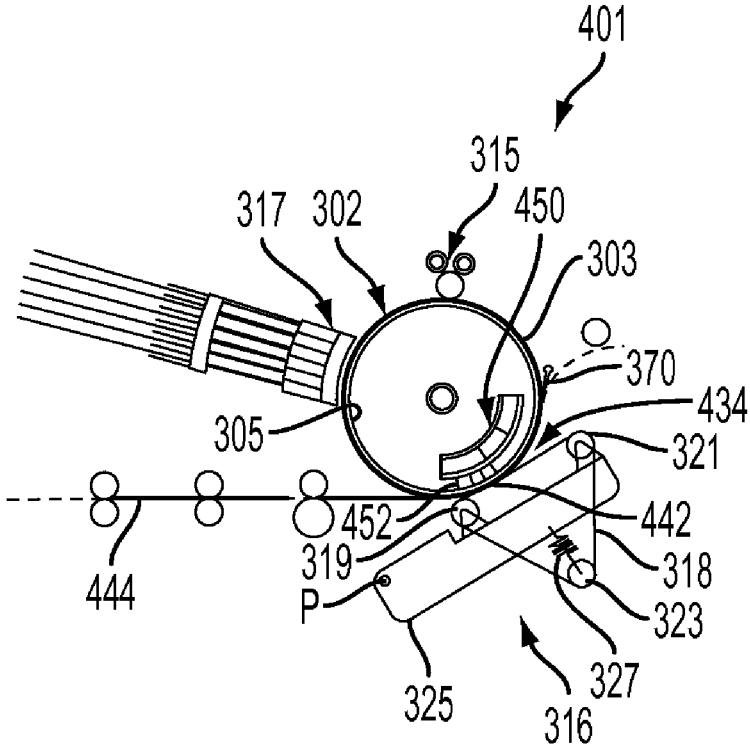
Figure 5C:
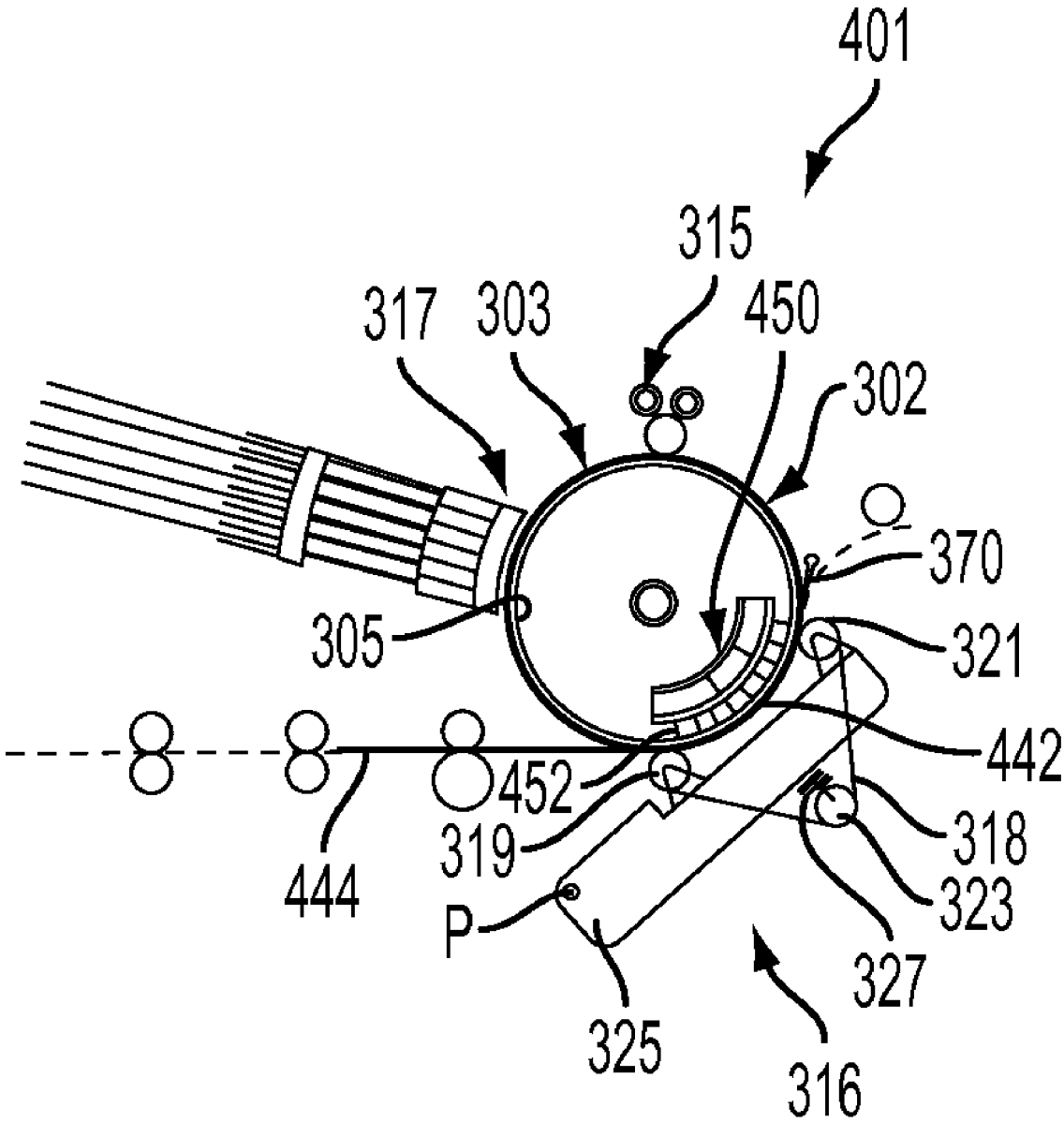

FIGS. 5A to 5C depict the sequential operation of another exemplary embodiment of a printing system 401 that can provide progressive engagement with media over the length of an image transfer/curing zone, and that includes a radiant energy device that allows progressive radiant energy exposure of images along the image transfer/curing zone without the use of a moving radiant energy shield. This progressive exposure can be achieved using an addressable array of light-emitting diodes (LEDs) that emit radiant energy of the desired wavelength and can be progressively turn ON or OFF. The printing system 401 can be used, e.g., in place of the printing system 301 in the printing apparatus 300 shown in FIG. 3.

The printing system 401 includes an intermediate drum 402. The intermediate drum 402 can have the same construction as the intermediate drum 302 shown in FIG. 4, for example. A marking system 417 including an array of print heads (e.g., ink-jet print heads) is operable to apply inks to the outer surface 403 of the intermediate drum 402 rotating in the counter-clockwise direction. An image is built on the intermediate drum 402 via multiple passes past the marking system 417. An ink supply system (not shown) is in communication with the respective print heads of the marking system 417. A cleaning device 415 cleans the outer surface 403 of the intermediate drum 402 during rotation.

The printing system 401 further includes a transport device 316. The transport device 316 can have the same construction as the transport device 316 of the printing system 301 shown in FIG. 3.

Media are fed to the image transfer/curing zone 434. At the image transfer/curing zone 434, an image is transferred from the intermediate drum 302 to a medium, and the image is exposed to radiant energy to cure the ink forming the image. The transport belt 318 applies sufficient pressure to the medium at the image transfer/curing zone 434 to result in physical leveling of the ink.

In the printing system 401, the transport device 316 is movable relative to the intermediate drum 302 in a controlled manner to progressively engage with media, beginning with the lead edges of the media. The transport device 316 can be moved relative to the intermediate drum 302 in the following manner. First, the transport device 316 is moved upwardly until the inlet end of the transport belt 318 overlying the roll 319 engages with the intermediate drum 302 and a medium. Then, the transport device 316 is pivoted counter-clockwise about the pivot axis P as the medium advances in the process direction. As the transport device 316 is pivoted, the compliant span of the transport belt 318 extending between the rolls 319, 321 is deflected and the length of the image transfer/curing zone 434 along which the intermediate drum 302 and the transport belt 318 both engage with the advancing medium progressively increases.

The printing system 401 includes a radiant energy source 450 located internal to the intermediate drum 302 and which faces the inner surface 305. The radiant energy source 450 emits radiant energy 452 of the desired wavelength range for curing ink applied to the intermediate drum 302. The illustrated radiant energy source 450 includes an array of circumferentially-spaced light-emitting diodes that emit radiant energy of a wavelength range effective to cure radiation-curable ink. The ink can be UV curable ink composition. The radiant energy source 450 can extend over an angular range of, e.g., about 90°, as shown. The intermediate drum 302 is substantially transparent to the radiant energy 452 emitted by the radiant energy source 450 to allow the radiant energy 452 to impinge on media at the image transfer/curing zone 434.

The light-emitting diodes of the radiant energy source 450 are addressable and can be sequentially turned on as a medium advances along the image transfer/curing zone 434. Depending on how collimated the light emitted from the light-emitting diodes is, barrier strips may be placed between adjacent light-emitting diodes to focus the radiant energy for irradiating media at the image transfer/curing zone 434.

The sequential activation of the light-emitting diodes of the radiant energy source 450 allows images formed on the intermediate drum 302 to be protected from exposure to the radiant energy 452. This sequential activation allows progressive exposure of an image on a medium as the medium move along the length of the image transfer/curing zone 434 in contact with the intermediate drum 302 and the transport belt 318. The sequential activation of the light-emitting diodes is synchronized with the pivoting of the transport device 316 in the counter-clockwise direction and the associated progressive engagement of the transport belt 318 with a medium to allow the image only on the portion of the intermediate drum 302 that is ready for transfer to a medium to be irradiated. The radiant energy source 450 and the transport device 316 can be connected to a controller (not shown) configured to control the operation of these devices.

The printing system 401 includes a stripping element 370 for mechanically stripping media from the outer surface 303 of the intermediate drum 302 after passing through the image transfer/curing zone 434.

FIG. 5A depicts a first medium 442 approaching the image transfer/curing zone 434. A second medium 444 is shown trailing the first medium 442.

FIG. 5B depicts the first medium 442 after entering the image transfer/curing zone 434. The first medium 442 is engaged by the outer surface 303 of the intermediate drum 302 and the transport belt 318. Some of the light-emitting diodes of the radiant energy source 450 are sequentially activated to emit radiant energy 452. Radiating of the first medium 442 is commenced when its leading edge enters the image transfer/curing zone 434.

As the first medium 442 continues to advance in the process direction, the transport device 316 is pivoted counter-clockwise to cause the transport belt 318 to progressively engage with the first medium 342 and increase the length of the image transfer/curing zone 434, as depicted in FIGS. 5B and 5C. As the first medium 442 advances along the image transfer/curing zone 434, pressure is applied by the transport belt 318 to level the ink. Additional ones of the light-emitting diodes of the radiant energy source 450 are activated as the first medium 442 advances to progressively expose an increasing length of the image that has been transferred to the first medium 442 to radiant energy 452.

In embodiments, the transport belt 318 is maintained in the engaged position while all media of a print run pass through the image transfer/curing zone 434.

The transport device 316 of the printing system 401 can also be progressively disengaged as the trailing edge of the last medium passes through the image transfer/curing zone 434. Although not shown, the transport device 316 can be progressively disengaged starting by moving the inlet end of the transport belt 318 downwardly away from the intermediate drum 302, followed by pivoting the transport device 316 clockwise. This movement of the transport device 316 allows a newly-formed image on the intermediate drum 302 to pass through the image transfer/curing zone 334 without being contacted by the transport belt 318. The radiant energy emission from the radiant energy source 350 can be sequentially turned OFF. This progressive disengagement allows the next set of images to be placed immediately after the last image of the previous image set to maximize productivity. Alternatively, a "blank" section without an image can be left on the intermediate drum 302 to give the printing system 401 sufficient time to fully disengage.

In embodiments of the printing system including an intermediate belt, such as the printing system 201, the radiant energy source can include a plurality of individual sources, such as an array of light-emitting diodes, to irradiate images on media at the image transfer/curing zone. In such embodiments, the individual radiant energy sources can be sequentially activated to progressively expose images on media. The radiating device can optionally include a radiant energy shield for controlling exposure of media along the image transfer/curing zone.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A printing system, comprising:

a rotatable intermediate member including an outer surface on which marking material can be applied by a marking system to form an image via multiple passes of the intermediate member past the marking system;

a transport device including a rotatable transport belt having an inlet end and an outlet end, the transport device being movable relative to the outer surface of the intermediate member to engage the transport belt with a medium starting at the inlet end at which a leading edge of the medium enters and progressively increase a length of an engagement zone in which the transport belt is in contact with the medium in a direction toward the outlet end as the leading edge of the medium is advanced from the inlet end to the outlet end, the outer surface and the transport belt forming an image transfer/curing zone along which the image is transferred from the outer surface to the medium, the image transfer/curing zone increasing in length as the transport belt is progressively engaged with the advancing medium; and a radiating device including a radiant energy source adapted to simultaneously progressively expose the image to radiant energy while the image is being transferred to the medium along the image transfer/curing zone.

2. The printing system of claim 1, wherein the intermediate member comprises a continuous intermediate belt including the outer surface, the radiant energy source is disposed internal to the intermediate belt, and the intermediate belt is comprised of a material that is substantially transparent to the radiant energy.

3. The printing system of claim 2, wherein:

the transport belt is entrained on a first roll disposed at the inlet end and a second roll disposed at the outlet end;

the transport belt has a compliant surface between the inlet end and the outlet end;

the first roll is connected to a first drive;

the second roll is connected to a second drive;

the first drive is operable to move the inlet end of the transport belt into engagement with the outer surface of the intermediate belt; and the second drive is operable to move the outlet end of the transport belt toward the outer surface of the intermediate belt with the inlet end of the transport belt engaged with the outer surface to progressively engage the transport belt between the inlet end and the outlet end with the medium.

4. The printing system of claim 3, wherein:

the first drive is operable to move the inlet end of the transport belt away from the outer surface of the intermediate belt and the second drive is operable to then move the outlet end of the transport belt away from the outer surface of the intermediate belt to progressively disengage the transport belt between the outlet end and the inlet end from the medium and decrease the length of the image transfer/curing zone; and the radiating device is operable to progressively decrease the size of a radiant energy exposure region as the transport belt is disengaged from the medium.

5. The printing system of claim 2, wherein the transport device comprises at least one spring element disposed internal to the transport belt, and the at least one spring element produces a force that causes the transport belt to apply pressure to the medium at the image transfer/curing zone.

6. The printing system of claim 1, wherein the radiating device comprises a radiant energy shield which is movable along the image transfer/curing zone as the transport belt is progressively engaged with the advancing medium to progressively expose the image to radiant energy as the image is simultaneously being transferred to the medium along the image transfer/curing zone.

7. The printing system of claim 1, wherein the intermediate member comprises an intermediate drum including the outer surface, the radiating device is disposed internal to the intermediate drum and the intermediate drum is comprised of a material that is substantially transparent to the radiant energy.

8. The printing system of claim 1, wherein the radiating device comprises an array of light-emitting diodes which can be sequentially activated to progressively expose the image to radiant energy as the image is simultaneously being transferred to the medium along the image transfer/curing zone.

9. The printing system of claim 7, wherein the transport device is rotatable relative to the outer surface of the intermediate drum to progressively engage the transport belt with the medium starting from the inlet end and progressing toward the outlet end as the leading edge of the medium advances.

10. The printing system of claim 7, wherein:

the transport belt is entrained on a first roll disposed at the inlet end and a second roll disposed at the outlet end;

the transport belt has a compliant surface between the inlet end and the outlet end; and the transport device is movable to position the inlet end of the transport belt into engagement with the outer surface of the intermediate drum and then to rotate the outlet end of the transport belt toward the outer surface of the intermediate drum with the inlet end of the transport belt engaged with the outer surface to progressively engage the transport belt between the inlet end and the outlet end with the medium.

11. The printing system of claim 10, wherein:

the transport device is movable to move the inlet end of the transport belt away from engagement with the outer surface of the intermediate drum and to then move the outlet end of the transport belt away from the outer surface of the intermediate drum to progressively disengage the transport belt between the outlet end and the inlet end from the medium and decrease the length of the image transfer/curing zone; and the radiating device is operable to progressively decrease the size of a radiant energy exposure region as the transport belt is disengaged from the medium.

12. A printing apparatus, comprising:

a rotatable intermediate member including an outer surface;

a marking section adapted to apply marking material to the outer surface of the intermediate member to form an image on the outer surface via multiple passes of the intermediate member past the marking section;

a transport device including a rotatable transport belt having an inlet end and an outlet end, the transport device being movable relative to the outer surface of the intermediate member to engage the transport belt with a medium starting at the inlet end at which a leading edge of the medium enters and progressively increase a length of an engagement zone in which the transport belt is in contact with the medium in a direction toward the outlet end as the leading edge of the medium is advanced from the inlet end to the outlet end, the outer surface and the transport belt forming an image transfer/curing zone along which the image is transferred from the outer surface to the medium, the image transfer/curing zone increasing in length as the transport belt is progressively engaged with the advancing medium; and a radiating device including a radiant energy source adapted to simultaneously progressively expose the image to radiant energy while the image is being transferred to the medium along the image transfer/curing zone.

13. The printing apparatus of claim 12, wherein the intermediate member comprises a continuous intermediate belt, the radiant energy source is disposed internal to the intermediate belt, and the intermediate belt is comprised of a material that is substantially transparent to the radiant energy.

14. The printing apparatus of claim 13, wherein the radiating device comprises a radiant energy shield which is movable along the image transfer/curing zone as the transport belt is progressively engaged with the advancing medium to progressively expose the image to radiant energy as the image is simultaneously being transferred to the medium along the image transfer/curing zone.

15. The printing apparatus of claim 12, wherein the intermediate member comprises an intermediate drum, the radiating device is disposed internal to the intermediate drum and the intermediate drum is comprised of a material that is substantially transparent to the radiant energy.

16. The printing apparatus of claim 12, wherein the radiating device comprises an array of light-emitting diodes which can be sequentially activated to progressively expose the image to radiant energy as the image is simultaneously being transferred to the medium along the image transfer/curing zone.

17. The printing apparatus of claim 16, wherein the transport device is rotatable relative to the outer surface of the intermediate drum to progressively engage the transport belt with the medium starting from the inlet end and progressing toward the outlet end as the leading edge of the medium advances.

18. The printing apparatus of claim 12, wherein the marking system comprises a plurality of ink jet print heads.

19. A method of forming images on media in a printing system, comprising:

forming an image on an outer surface of a rotating intermediate member via multiple passes of the intermediate member past a marking system;

moving a transport device including a rotatable transport belt having an inlet end and an outlet end relative to the outer surface of the intermediate member to engage the transport belt with a medium starting at the inlet end at which a leading edge of the medium enters and progressively increase a length of an engagement zone in which the transport belt is in contact with the medium in a direction toward the outlet end as the leading edge of the medium is advanced from the inlet end to the outlet end, the outer surface and the transport belt forming an image transfer/curing zone along which the image is transferred from the outer surface to the medium, the image transfer/curing zone increasing in length as the transport belt is progressively engaged with the advancing medium; and simultaneously progressively exposing the image to radiant energy emitted by a radiating device while the image is being transferred to the medium along the image transfer/curing zone.

20. The method of claim 19, wherein the intermediate member comprises a continuous intermediate belt including the outer surface, the radiant energy source is disposed internal to the intermediate belt, and the intermediate belt is comprised of a material that is substantially transparent to the radiant energy.

21. The method of claim 19, wherein the radiating device comprises a radiant energy shield which is moved along the image transfer/curing zone as the transport belt is progressively engaged with the advancing medium to progressively expose the image to radiant energy as the image is simultaneously being transferred to the medium along the image transfer/curing zone.

22. The method of claim 19, wherein the intermediate member comprises an intermediate drum including the outer surface, the radiating device is disposed internal to the intermediate drum and the intermediate drum is comprised of a material that is substantially transparent to the radiant energy.

23. The method of claim 19, wherein the radiating device comprises an array of light-emitting diodes which are sequentially activated to progressively expose the image to radiant energy as the image is simultaneously being transferred to the medium along the image transfer/curing zone.

24. The method of claim 22, wherein the transport device is rotated relative to the outer surface of the intermediate drum to progressively engage the transport belt with the medium starting from the inlet end and progressing toward the outlet end as the leading edge of the medium advances.

25. The method of claim 19, wherein the marking material is a UV-curable ink and the marking material is applied to the outer surface of the intermediate member by ink-jet print heads.

* * * * *